US005241394A

United States Patent [19]

Mutso et al.

[11] Patent Number: 5,241,394

[45] Date of Patent: Aug. 31, 1993

[54] CATHODE-RAY TUBE HAVING A SHRINKFIT IMPLOSION PROTECTION BAND WITH ENHANCED CORROSION RESISTANCE

[75] Inventors: Rein R. Mutso, Lancaster; Raymond E. Keller, Clarks Summit, both of Pa.

[73] Assignee: Thomson Consumer Electronics, Indianapolis, Ind.

[21] Appl. No.: 751,817

[22] Filed: Aug. 29, 1991

[51] Int. Cl.[5] ..... H01J 61/50

[52] U.S. Cl. ..... 358/246; 250/214 VT

[58] Field of Search ..... 250/213 VT; 358/246, 358/247-249

[56] References Cited

U.S. PATENT DOCUMENTS 2,785,820 3/1957 Vincent et al. ..... 220/2.1

4,121,257 10/1978 Krishnamurthy ..... 358/246

4,415,932 11/1983 Rogers ..... 358/246

*Primary Examiner*—Stephen Brinich

*Attorney, Agent, or Firm*—Joseph S. Tripoli; Dennis H. Irlbeck; Vincent J. Coughlin, Jr.

[57] ABSTRACT

A cathode-ray tube comprises an evacuated envelope which includes a faceplate panel joined to a funnel. A steel shrinkfit implosion protection band having a metallic protective coating thereon is fitted around the periphery of the panel to apply a compressive force thereto. The corrosion resistance of the band is enhanced by providing a metallic barrier layer between the steel band and the metallic protective coating.

A method of forming the enhanced corrosion resistant band also is disclosed.

18 Claims, 2 Drawing Sheets

CATHODE-RAY TUBE HAVING A SHRINKFIT IMPLOSION PROTECTION BAND WITH ENHANCED CORROSION RESISTANCE

The invention relates generally to cathode-ray tubes (CRT's) having implosion protection bands and, more particularly, to such tubes having shrinkfit implosion protection bands with enhanced corrosion resistance.

BACKGROUND OF THE INVENTION

A cathode-ray tube is evacuated to a very low internal pressure and accordingly is subject to the possibility of implosion due to the stresses produced by atmospheric pressure acting on all surfaces of the tube. This problem has been addressed in the art by providing the CRT with an implosion protection band. Such a band is used to apply a compressive force to the sidewall of a faceplate panel of the CRT to redistribute some of the forces. The redistribution of the forces decreases the probability of an implosion of the tube by minimizing tension in the corners of the panel. An implosion protection band also is beneficial because it improves the impact resistance of the tube. Glass in compression is stronger than glass which is in tension and the band causes compression in panel areas which otherwise would be in tension. Additionally, in the event of an implosion, the redistributed stresses cause the imploding glass to be directed toward the back of the cabinet in which the tube is mounted, thereby substantially reducing the probability of someone in the vicinity of the imploding tube being injured.

Steel is the preferred material for many types of implosion protection bands because of its low cost and high strength.

U.S. Pat. No. 4,121,257, issued to V. R. Krishnamurthy on Oct. 17, 1978, describes the use of zinc, zinc-and-epoxy, and plastic coatings for steel tension or "T-band" systems in which coated steel strapping is applied to the tube, then tensioned and crimped, to provide implosion protection.

Epoxy and plastic coatings overlying a steel base cannot be used with shrinkfit bands. A shrinkfit-type band may be manufactured from a single, continuous steel piece, from a steel strip joined at the two ends, or from a plurality of steel strips joined together at the ends. The band, in each instance, is formed into a loop, the periphery of which is smaller than the periphery of the faceplate panel. The loop is heated to approximately 300° to 500° C. and the coefficient of expansion of the steel causes the loop to expand to dimensions which permit the loop to be slipped around the sides of the faceplate panel. As the band cools it shrinks and tightly surrounds the panel, thereby applying an inwardly directed compressive force to the faceplate panel to offset at least some of the outwardly directed tension forces which are produced on the faceplate by atmospheric pressure, when the tube is evacuated. The elevated temperatures applied to the band to expand it would damage an epoxy or plastic coating on the band and possibly foul the shrinkfit banding apparatus. Accordingly, such coatings cannot be used to provide corrosion resistance to the steel band.

Applicants have determined that a zinc coating applied to the steel band also is unacceptable for shrinkfit bands, because the elevated temperature, applied to the band to expand it, causes the zinc to react with the iron of the steel band to form intermetallic compounds with poor corrosion resistance to the humidity conditions often experienced during the transport and storage of the tubes. Intermetallic compounds, as the term is used herein, are alloys of two metals in which a progressive change in composition is accompanied by a progression of phases, differing in crystal structure, through the material. In order to enhance the corrosion protection of the shrinkfit steel band, it is necessary to inhibit the formation of such zinc-iron intermetallic compounds.

SUMMARY OF THE INVENTION

A cathode-ray tube comprises an evacuated envelope which includes a faceplate panel joined to a funnel. A shrinkfit implosion protection band having a ferrous metal base portion with a metallic protective coating thereon is fitted around the periphery of the panel to apply a compressive force thereto. The corrosion resistance of the band is enhanced by providing a metallic barrier layer between the ferrous metal base portion and the metallic protective coating.

DETAILED DESCRIPTION OF THE PREFERRED EMBODIMENT

Figure 1:
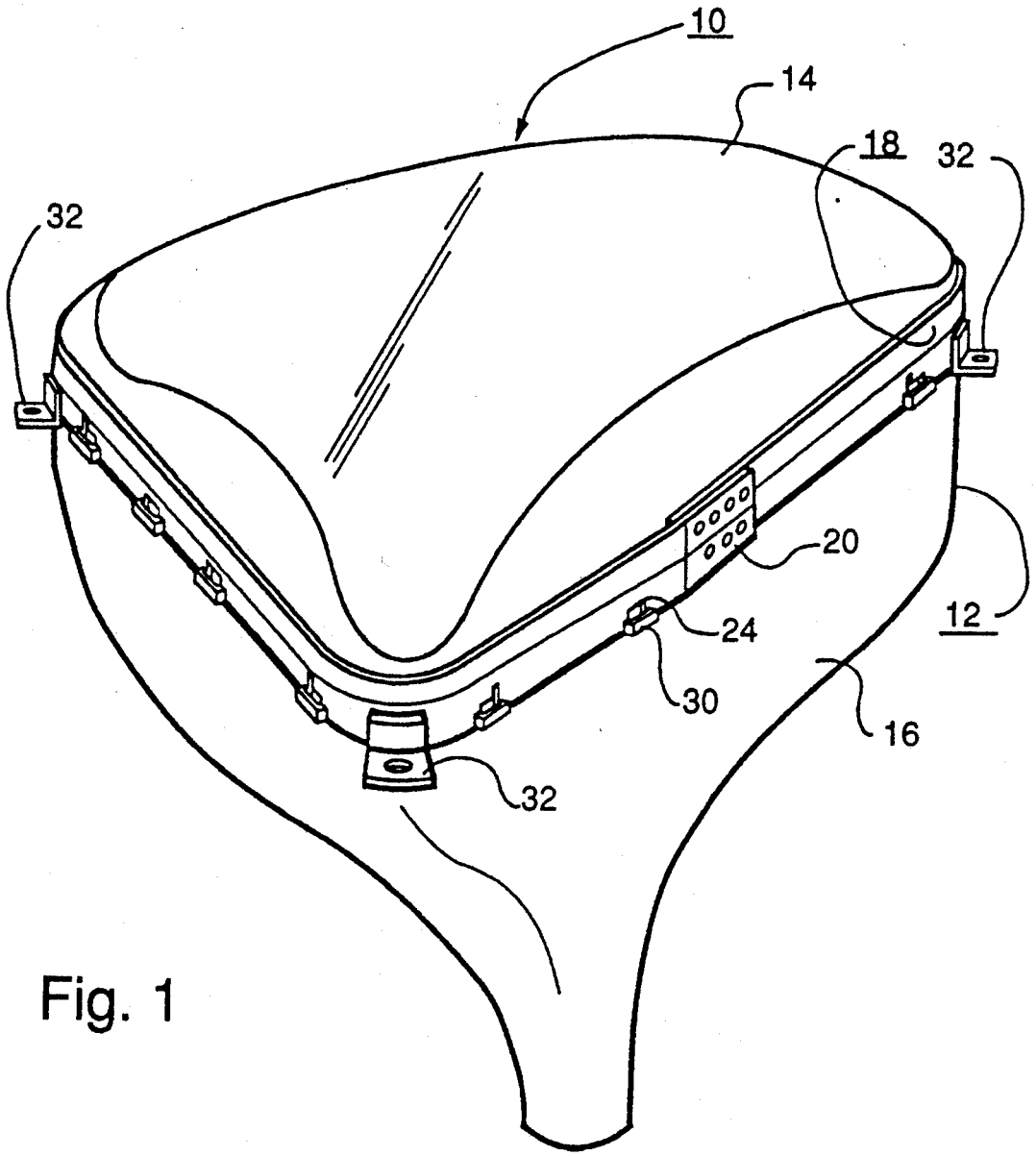
FIG. 1 is a perspective view of a CRT with a shrinkfit implosion protection band according to the present invention.

Referring to FIG. 1, a CRT 10 comprises an evacuated envelope 12 having a faceplate panel 14 joined by a frit seal, not shown, to a funnel 16. An electron gun, also not shown, closes the opposite end of the funnel.

A shrinkfit implosion protection band 18, in the form of a loop with cold dimensions slightly smaller than the periphery of the panel 14, is fitted around the panel by heating the band within the range of 300° to 500° C. to cause it to expand, and then allowing it to cool. The tension of the cooled band 18 applies a compressive force to the panel. The band 18 preferably is formed by joining together the opposite ends of at least one strip of ferrous metal to form a connective joint 20. Alternatively, the band may be formed from a single, continuous piece of metal or from a plurality of metal strips joined together at the ends. A plurality of openings 24 are formed adjacent to one edge of the band. A narrow strip of band material bridges the opening 24 and is formed out of the plane of the band to define a clip-receiving retainer 30 to accept a clip, not shown, which supports a degaussing coil, also not shown. A mounting lug 32 is attached to the band 18 at each of the corners to permit the tube to be secured within a housing.

Figure 2:
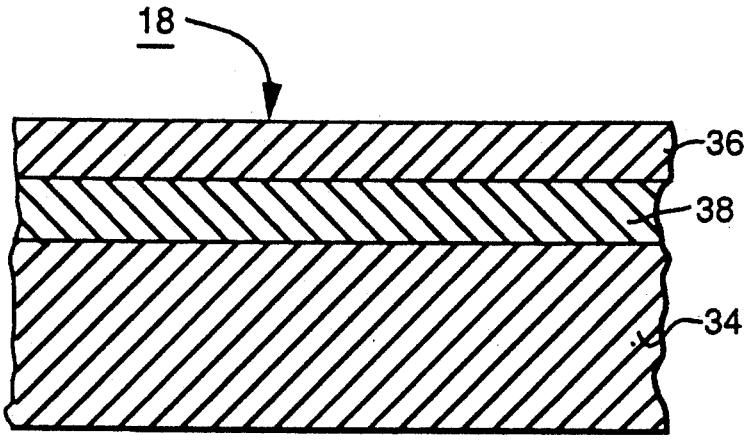
FIG. 2 is an enlarged sectional view of a portion of the shrinkfit implosion protection band prior to being fitted onto the tube.

An enlarged sectional view of the novel band 18, before being heated, is shown in FIG. 2. The band 18 comprises a base portion 34 of ferrous metal, such as carbon steel, or an alloy thereof such as stainless steel. A protective coating 36 overlies at least one surface of the base portion 34. The protective coating is a metal, preferably zinc, or a suitable zinc-containing intermetallic compound. Such zinc-containing intermetallic compounds include zinc-nickel, zinc-cobalt, zinc-manganese, zinc-chromium, zinc-gold, and zinc-silver, although zinc-nickel is preferred. A metallic barrier layer 38 is disposed between the base portion 34 and the protective coating 36. Suitable metals for the barrier layer 38 include nickel, cobalt, manganese, chromium, gold and silver, although nickel is preferred for cost and ease of application purposes. The barrier layer 38 and the protective coating 36 may be applied by any of the conventional techniques of plating, vacuum deposition, dipping, or sputtering. Typically, the barrier layer 38 has a thickness within the range of about $2.5\times10^{-5}$ to $1\times10^{-3}$ mm and the protective coating 36 has a thickness within the range of 2.5×10hu −5 to 2×10hu ×2 mm.

Figure 3:
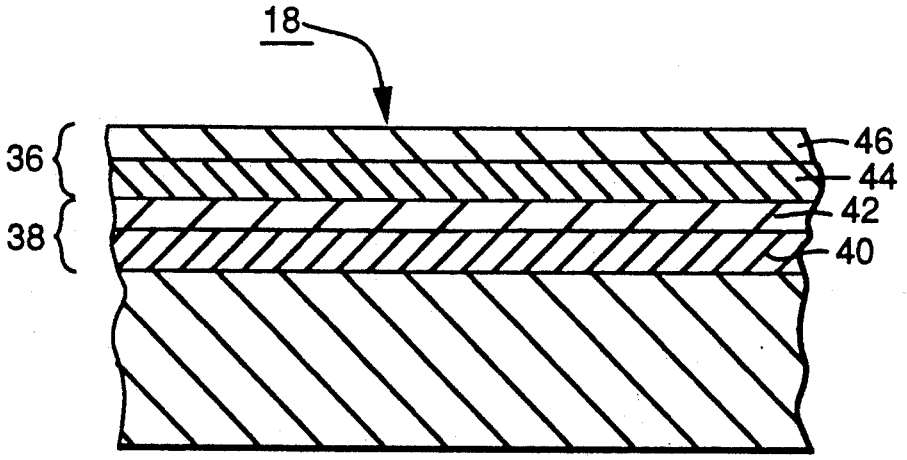
FIG. 3 is an enlarged sectional view of a portion of the band subsequent to being shrink-fitted on the tube.

To facilitate application of the band 18 around the periphery of the faceplate panel 14, the band is heated to approximately 300° to 500° C. to cause the metal of the band to expand. The heating tends to cause the formation of metal alloys at the interface between the barrier layer and the base portion and intermetallic compounds at the interface between the barrier layer and the protective coating. Where the barrier layer 38 comprises nickel, the protective coating 36 comprises zinc and the base 34 is steel, the resultant structure, after heating, is shown in FIG. 3. The barrier layer 38 includes at least a resultant metal alloy 40 consisting essentially of nickel-iron at the interface between the steel base 34 and the nickel barrier layer 38. Depending upon the duration of the band heating and the temperature, a layer of substantially pure nickel 42 may remain; however, the thickness of the nickel layer decreases with increasing heating time and temperature. Resultant intermetallic compounds 44 are formed at the interface of the nickel barrier layer 38 and the zinc protective coating 36. The resultant intermetallic compounds consist essentially of zinc-nickel and are characterized by a progression of phases, differing in crystal structure through the thickness of the region. Again, depending on the heating time and temperature, a thin layer of substantially pure zinc 46 may remain on the surface of the band 18.

Where cobalt is selected for the metal of the barrier layer 38, the resultant metal alloy 40 consists essentially of cobalt-iron and the resultant intermetallic compounds 44 consist essentially of zinc-cobalt. Similarly, where the metal barrier layer 38 comprises manganese, the resultant metal alloy 40 consists essentially of manganese-iron and the resultant intermetallic compounds 44 consist essentially of zinc-manganese; where the metal barrier layer comprises chromium, gold, or silver, the resultant metal alloys 40 consist essentially of chromium-iron, gold-iron, or silver-iron, respectively, and the resultant intermetallic compounds 44 consist essentially of zinc-manganese, zinc-gold, or zinc-silver, respectively.

The purpose of the barrier layer 38 and the intermetallic compounds and metal alloys included therein and bordering thereon is to prevent interaction between the zinc of the protective coating 36 and the iron of the base material 34. The corrosion resistance provided by the barrier layer, including the resultant intermetallic compounds 44, is superior to the corrosion resistance achieved when zinc interacts directly with the iron of the base material to form a zinc-iron intermetallic compound, as was the case in the prior art.

What is claimed is:

1. In a cathode-ray tube comprising an evacuated envelope having a faceplate panel joined to a funnel, a shrinkfit implosion protection band, said band having a ferrous metal base portion with a metallic, protective coating thereon, said band being fitted around the periphery of said panel to apply a compressive force thereto, the improvement wherein a metallic barrier layer is disposed between said ferrous metal base portion of said band and said protective coating to enhance the corrosion resistance of said band.

2. The tube as described in claim 1, wherein said barrier layer includes at least a resultant metal alloy formed at the interface between said barrier layer and said base portion.

3. The tube as described in claim 2, wherein said resultant metal alloy is selected from the group consisting of nickel-iron, cobalt-iron, manganese-iron, chromium-iron, gold-iron and silver-iron.

4. The tube as described in claim 2, wherein said barrier layer further includes a metal selected from the group consisting of nickel, cobalt, manganese, chromium, gold and silver.

5. The tube as described in claim 1, wherein said protective metallic coating includes at least resultant intermetallic compounds formed at the interface between said barrier layer and said protective coating.

6. The tube as described in claim 5, wherein said resultant intermetallic compounds are selected from the group consisting of zinc-nickel, zinc-cobalt, zinc-manganese, zinc-chromium, zinc-gold, and zinc-silver.

7. The tube as described in claim 5, wherein said protective coating further includes a layer of zinc.

8. In a cathode-ray tube comprising an evacuated envelope having a faceplate panel joined to a funnel, a shrinkfit implosion protection band, said band having a steel base portion with a protective metallic coating thereon, said band being fitted around the periphery of said panel to apply a compressive force thereto as a result of the tension of said band, the improvement wherein a metallic barrier layer being disposed between said steel base portion of said band and said protective metallic coating, said protective metallic coating providing enhanced corrosion resistance to said band.

9. The tube as described in claim 8, wherein said barrier layer includes at least a resultant metal alloy formed at the interface between said barrier layer and said steel base portion of said band.

10. The tube as described in claim 9, wherein said metal alloy is selected from the group consisting of nickel-iron, cobalt-iron, manganese-iron, chromium-iron, gold-iron and silver-iron.

11. The tube as described in claim 9, wherein said barrier layer further includes a metal selected from the group consisting of nickel, cobalt, manganese, chromium, gold and silver.

12. The tube as described in claim 8, wherein said protective metallic coating is selected from the group consisting of zinc and a suitable intermetallic compound.

13. The tube as described in claim 12, wherein said intermetallic compound is selected from the group consisting of zinc-nickel, zinc-cobalt, zinc-manganese, zinc-chromium, zinc-gold, and zinc-silver.

14. A method of forming a shrinkfit implosion protection band for a cathode-ray tube, said tube comprising an evacuated envelope having a faceplate panel joined to a funnel, said shrinkfit implosion protection band having a ferrous metal base portion with a metallic protective coating thereon, said method comprising the steps of a) providing a metallic barrier layer between said base portion and said protective coating, b) expanding the dimensions of said band by stretching said band into a loop with cold dimensions slightly smaller than the periphery of said panel prior to the application of said band, c) heating said band so that the dimensions thereof exceed those of the periphery of said panel, said heating creating a resultant metal alloy at the interface between said barrier layer and said ferrous metal base portion and resultant intermetallic compounds at the interface between said barrier layer and said protective coating, and d) fitting said band around the periphery of said panel to apply a compressive force thereto as a result of the tension of said band.

15. The method recited in claim 14, wherein said metal alloy is selected from the group consisting of nickel-iron, cobalt-iron, manganese-iron, chromium-iron, gold-iron and silver-iron.

16. The method recited in claim 14, wherein said barrier layer further includes a metal selected from the group consisting of nickel, cobalt, manganese, chromium, gold, and silver.

17. The method recited in claim 14, wherein said resultant intermetallic compounds are selected from the group consisting of zinc-nickel, zinc-cobalt, zinc-manganese, zinc-chromium, zinc-gold, and zinc-silver.

18. The method recited in claim 14, wherein said protective coating further includes a layer of zinc.

* * * * *

UNITED STATES PATENT AND TRADEMARK OFFICE

CERTIFICATE OF CORRECTION

PATENT NO. : 5,241,394

DATED : August 31, 1993

INVENTOR(S) : Rein Roman Mutso and Raymond Edward Keller

It is certified that error appears in the above-identified patent and that said Letters Patent is hereby corrected as shown below:

Col. 3, line 10, change "2.5 x 10hu-5 to 2 x 10hu x 2" to --$2.5 \times 10^{-5}$ to $2 \times 10^{-2}$--.

Signed and Sealed this

Fifteenth Day of March, 1994

Bruce Lehman

*Attest:*

BRUCE LEHMAN

*Attesting Officer*

*Commissioner of Patents and Trademarks*